United States Patent [19]

Furuya

[11] 4,362,177

[45] Dec. 7, 1982

[54] COIN COUNTING APPARATUS FOR COIN HANDLING MACHINE

[75] Inventor: Katusuke Furuya, Tokyo, Japan

[73] Assignee: Laurel Bank Machine Co., Ltd., Tokyo, Japan

[21] Appl. No.: 214,729

[22] Filed: Dec. 9, 1980

[30] Foreign Application Priority Data

Dec. 29, 1979 [JP] Japan ..... 54-182588[U]

[51] Int. Cl.[3] ..... G07D 9/04

[52] U.S. Cl. ..... 133/8 R

[58] Field of Search ..... 133/8 R, 8 A, 8 C, 8 E; 235/92 CN

[56] References Cited

U.S. PATENT DOCUMENTS 3,240,215 3/1966 Kamei ..... 133/8 R 4,216,788 8/1980 Watanabe ..... 235/92 CN

*Primary Examiner*—Stanley H. Tollberg

*Attorney, Agent, or Firm*—Fleit & Jacobson

[57] ABSTRACT

A coin counting system for use with a coin handling apparatus such as a coin counting apparatus, a coin sorting apparatus or a coin wrapping apparatus includes a coin guide for guiding a series of coins to be counted therealong and a belt conveyor for conveying the coins in the guide. A light source is disposed at a downstream portion of the guide. Pre- and post-sensors are juxtaposed to each other upstream and downstream in the coin conveying direction and are arranged to receive the light from the light source and to be included temporarily within the generally triangular space, which is defined by the inner wall of the coin guide and by the facing circumferential portions of the two coins being conveyed adjacent to each other, thereby to generate respective signals. A generator circuit is made receptive of the signals of the two sensors for generating an addition signal, when the two coins pass in the normal order from the pre-sensor to the post-sensor, and a subtraction signal when the two coins pass in the abnormal order from the post-sensor to the pre-sensor. Structure is made responsive to the addition and subtraction signals of the control circuit for generating a count signal, when in the normal order, but not when in the abnormal order. A counter counts up the number of the coins in response to the count signal. Thus, the coin having been counted can be prevented from being erroneously counted up even if it is conveyed backward.

5 Claims, 7 Drawing Figures

COIN COUNTING APPARATUS FOR COIN HANDLING MACHINE

BACKGROUND OF THE INVENTION

1. Field of the Invention

The present invention relates to a coin counting system to be used with a coin handling apparatus such as a coin counting apparatus, a coin sorting apparatus of a coin wrapping apparatus for counting the number of coins.

2. Description of the Prior Art

In a coin counting apparatus, for example, a star gear having such teeth as are generally suitable for the circumferences of coins is used to count up a counter, each time one tooth is advanced, so that the number of the coins is counted. This counting operation has, however, a drawback in that the rotational inertia of the star gear is so strongly exerted, when the counting speed is increased, that the number of the coins is liable to be indicated in the counting as one more than the actual number.

On the other hand, there is also proposed a concept, in which the coins are counted in a contacting manner each time out of them passes. However, since the arm or the like for stopping the counting operation is made integral with the roller to be brought into contact with the coming coin, that concept has a drawback in that the total weight is increased to such an extent that the working inertia is accordingly increased thereby kindling a prompt and reliable operation.

Therefore, the present invention has been completed in view of the fact that the coins to be counted by the coin handling apparatus are conveyed in contact on a coin path by a conveyor belt while forming the generally triangular space which is defined by the inner wall of the coin path and by the facing circumferential portions of the two coins being conveyed adjacent to each other.

SUMMARY OF THE INVENTION

Therefore an object of the present invention is to provide a reliable coin counting system without any erroneous operation, which can accomplish smooth and prompt counting operations although it has a simple construction.

Another object of the present invention is to provide a coin counting system which prevents one coin having been counted from being over counted, even if it is conveyed backward, in case a conveyor belt for conveying coins to be counted has its running direction reversed by a reaction when it is stopped or in case the conveyor belt is manually reversed when a coin path is jammed up with the coins.

In order to attain these objects, according to the present invention, there is provided a coin counting system comprising: a coin path for guiding a series of coins to be counted therealong; conveying means juxtaposed to said coin path for conveying the coins on said coin path; light emitting means disposed at a downstream portion of said coin path for emitting a light; pre- and post-sensors juxtaposed to each other upstream and downstream in the coin conveying direction and arranged to receive the light emitted from said light emitting means and to be at least included temporarily within the generally triangular space, which is defined by the inner wall of said coin path and by the facing circumferential portions of the two coins being conveyed adjacent to each other along said coin path, thereby generating respective signals; a generator circuit made responsive to the signals of said pre- and post-sensors for generating an addition signal, when said two coins pass in the normal order from said pre-sensor to said post-sensor, and a subtraction signal when said two coins pass in the abnormal order from said post-sensor to said pre-sensor; means made receptive of the addition and subtraction signals of said generator circuit for generating a count signal in response to the addition signal and for generating no count signal by the addition signal subsequent to the substraction signal in response to the substraction signal and a counter for counting up the number of said coins, when it receives said count signal, whereby the coin having been counted can be prevented from being erroneously counted again even it is conveyed backward.

BRIEF DESCRIPTION OF THE DRAWINGS

Other objects and advantages of the present invention will become apparent from the following description made in conjunction with the accompanying drawings, in which.

DESCRIPTION OF THE PREFERRED EMBODIMENT

The present invention will be described in the following in connection with the embodiment thereof with reference to the accompanying drawings.

Figure 1:
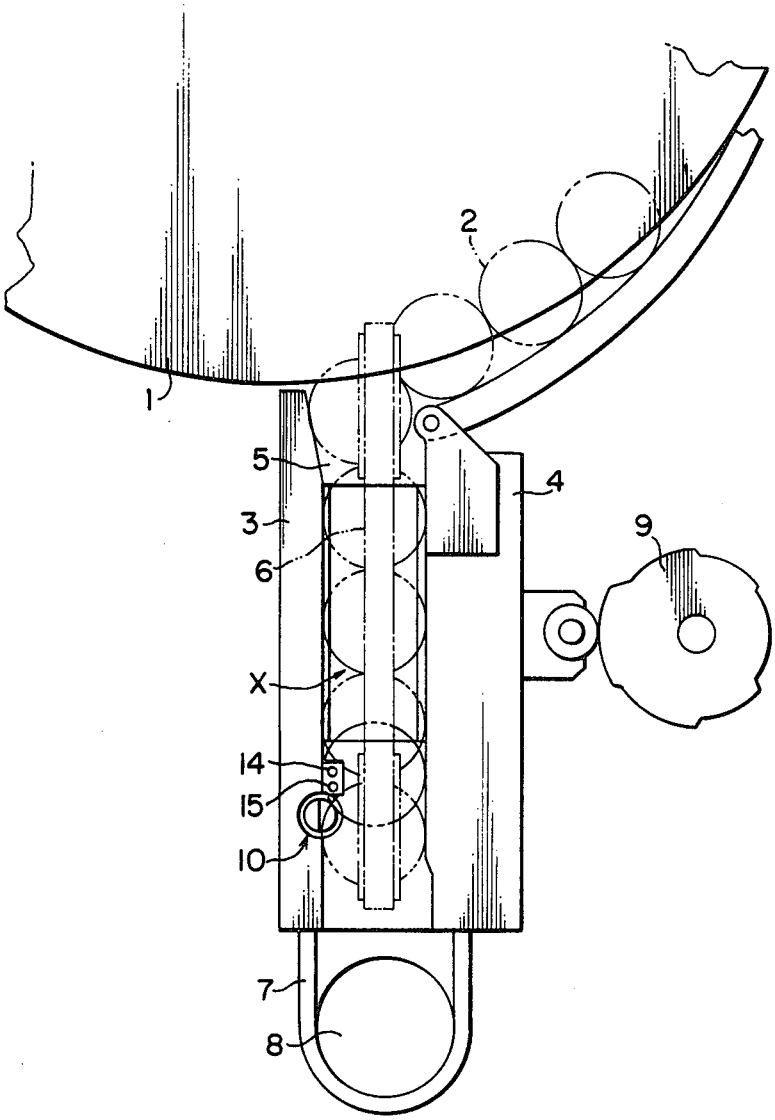
FIGS. 1, 2 and 3 are a top plane view, a front elevated view and a perspective view showing an essential mechanism of a coin handling apparatus, respectively.
Figure 2:
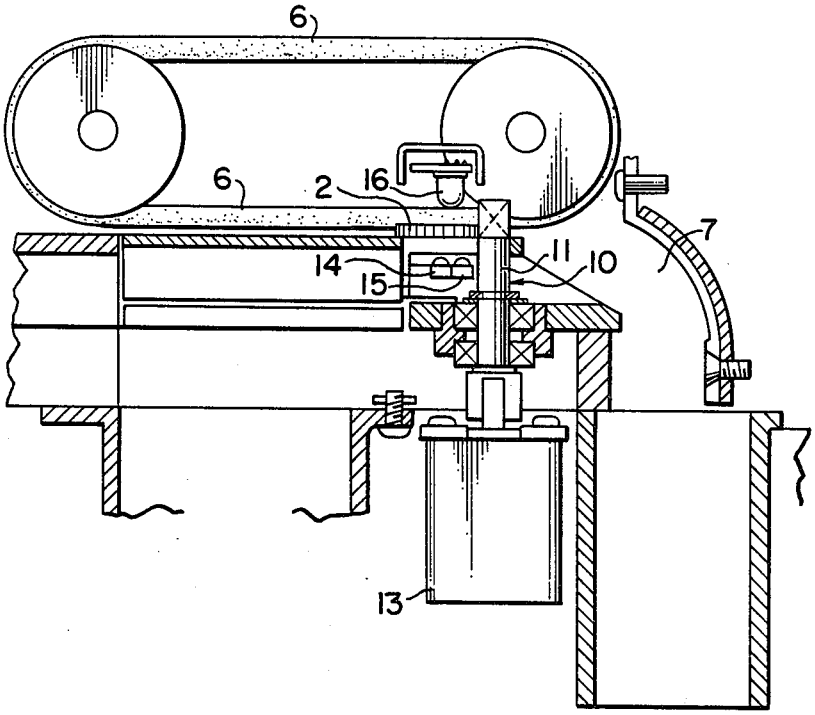
Figure 3:
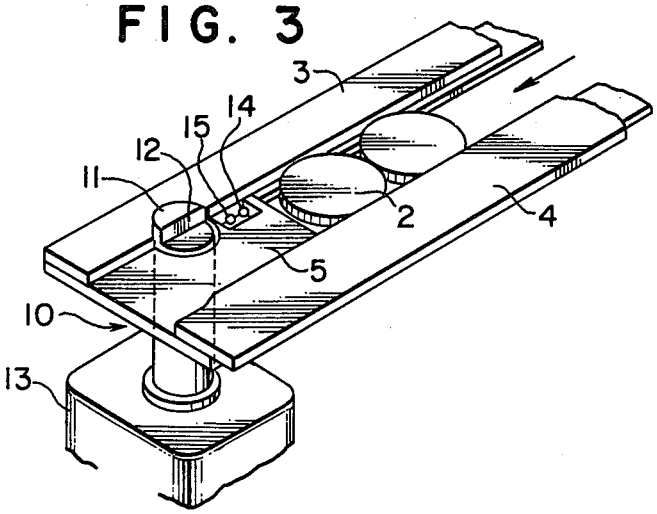

FIGS. 1, 2 and 3 are a top plane view, a front elevated view and a perspective view showing an essential mechanism of a coin handling apparatus, respectively. Reference numeral 1 appearing in the accompanying drawings indicates a rotary disc, and coins 2 supplied onto this rotary disc 1 are conveyed in series at a high speed, while receiving a pressure from a conveyor belt 6, in a coin path 5 between a stationary guide plate 3 and an adjustable guide plate 4 until they are introduced into an accumulating cylinder 8 through a corresponding chute 7. Here, the aforementioned adjustable guide plate 4 is so shifted by a path width setting cam 9 in accordance with the kind of the coins to be counted so as to adjust the width of the coin path 5. At the side of the stationary guide plate 3 of the coin path 5, there is disposed a coin stopper 10 which is equipped with a stopper shaft 11. This stopper shaft 11 has its axis intersecting the bottom of the coin path 5 at a right angle and is arranged at a position including the stationary guide plate 2 and the coin path 5. Moreover, the stopper shaft 11 has its head formed with such a notch as to cut on the extension of the inner wall of the stationary guide plate 3. The stopper shaft 11 thus constructed is connected to the shaft of a rotary solenoid 13. According to the present invention, there are provided pre- and post-sensors 14 and 15 which are juxtaposed to each other within the aforementioned coin path 5 upstream and downstream in the coin conveying direction. Those sensors 14 and 15 are so arranged as to be included temporarily within the generally triangular space X, which is defined by the inner wall of the stationary guide plate 3 and by the facing circumferential portions of the two coins 2 running adjacent to each other, while having their portions contacting with each other, i.e., that they are not shielded with the coins 2 at the instant when that space X passes. Moreover, those two sensors 14 and 15 are constructed of phototransistors for receiving the light coming from a light source 16, which is a diode for emitting an ultrared ray and which is disposed above the two sensors 14 and 15 across the portion of the coin path 5 where the aforementioned space X passes.

Figure 4:
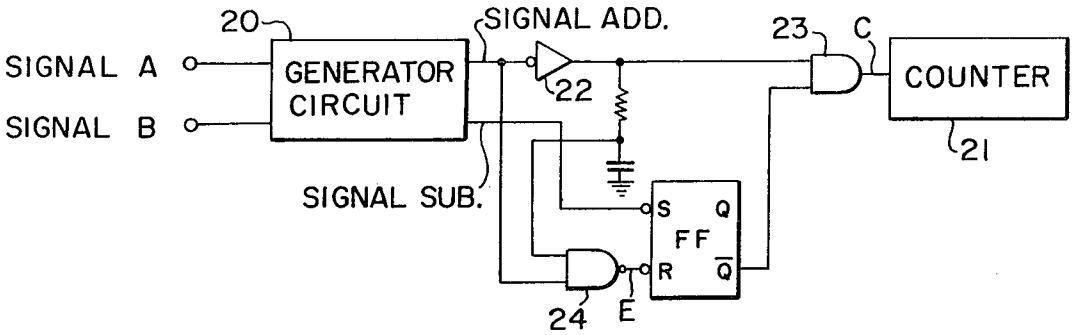
FIG. 4 is a circuit diagram showing one embodiment of a coin counting system according to the present invention.
Figure 5:
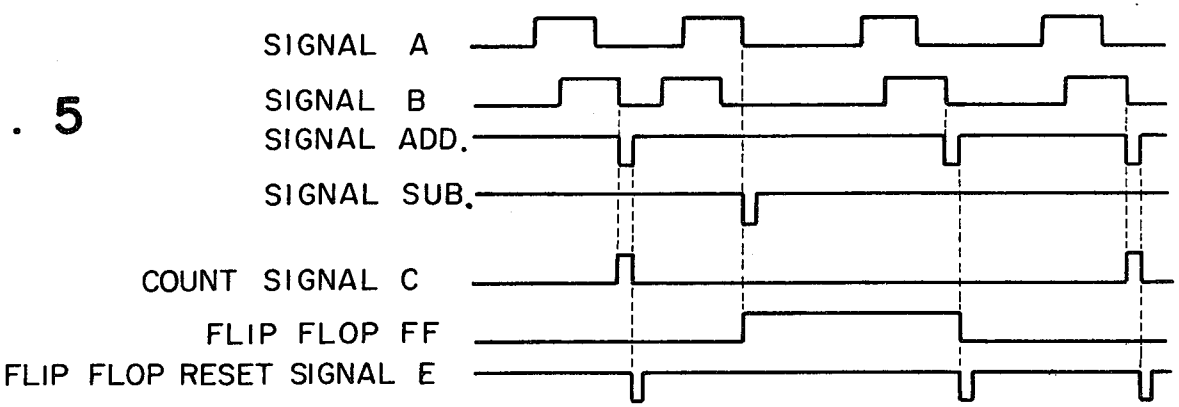
FIG. 5 is a time chart for explaining the operations of the coin counting system of FIG. 4.

FIGS. 4 and 5 are a circuit diagram and a time chart showing one embodiment of the coin counting system according to the present invention, respectively. This coin counting system is constructed principally of: an addition and substraction signal generator circuit 20, which is made responsive to the signals A and B of the aforementioned pre- and post-sensors 14 and 15 for generating an addition signal ADD, when the coins pass in the normal order from the pre-sensor 14 to the post-sensor 15, and a subtraction signal SUB when the coins pass in the abnormal order from the post-sensor 15 to the pre-sensor 14; and a counter 21 to be operated in response to a preset count signal C which is fed in accordance with the aforementioned addition and subtraction signals ADD and SUB of the generator circuit 20. Moreover, the coin counting system thus constructed generates one count signal C thereby counting up the coins 2 each time one addition signal ADD is generated. However, when the coins 2 are conveyed backward in the coin path 5 so that one subtraction signal SUB is generated, a flip-flop FF is so set that the count signal C is not generated even if the subsequent addition signal ADD is generated. This subsequent addition signal ADD returns the flip-flop FF to such a reset state that the subsequent normal counting operation may be prepared.

Figure 6:
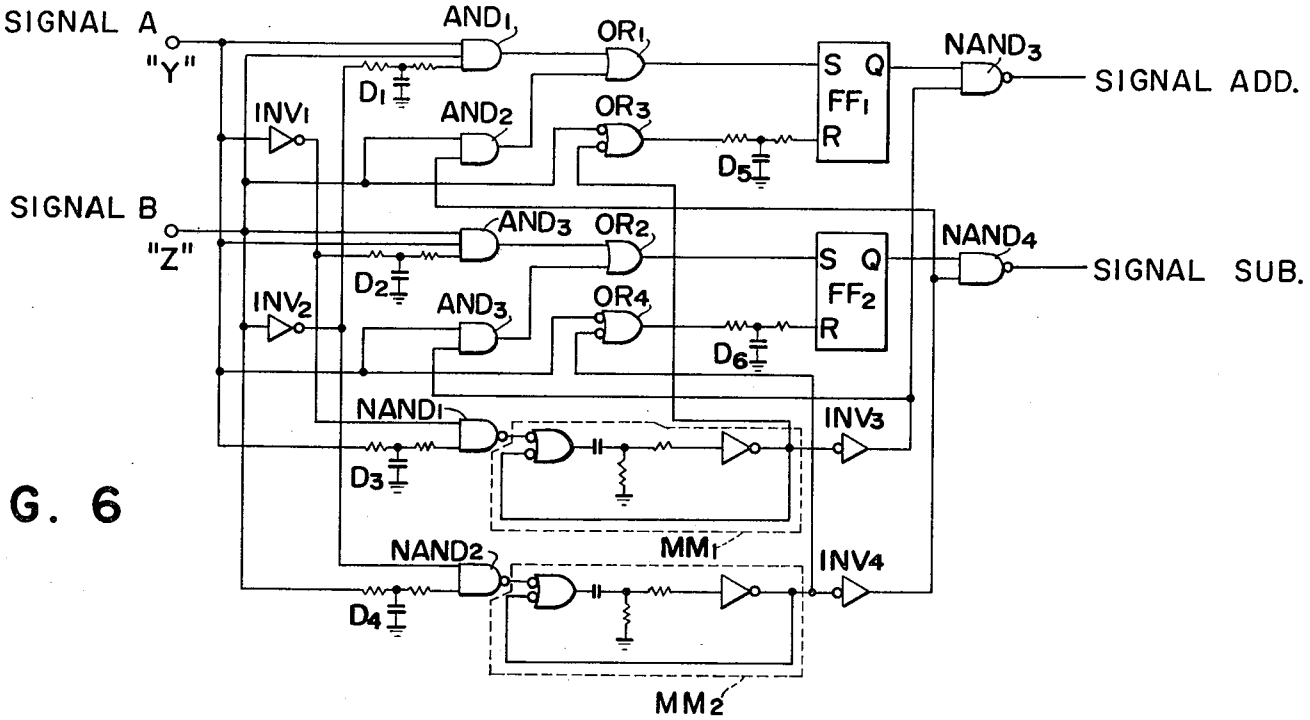
FIG. 6 is a circuit diagram showing one embodiment of the generator circuit included in the circuit diagram of FIG. 4.
Figure 7:
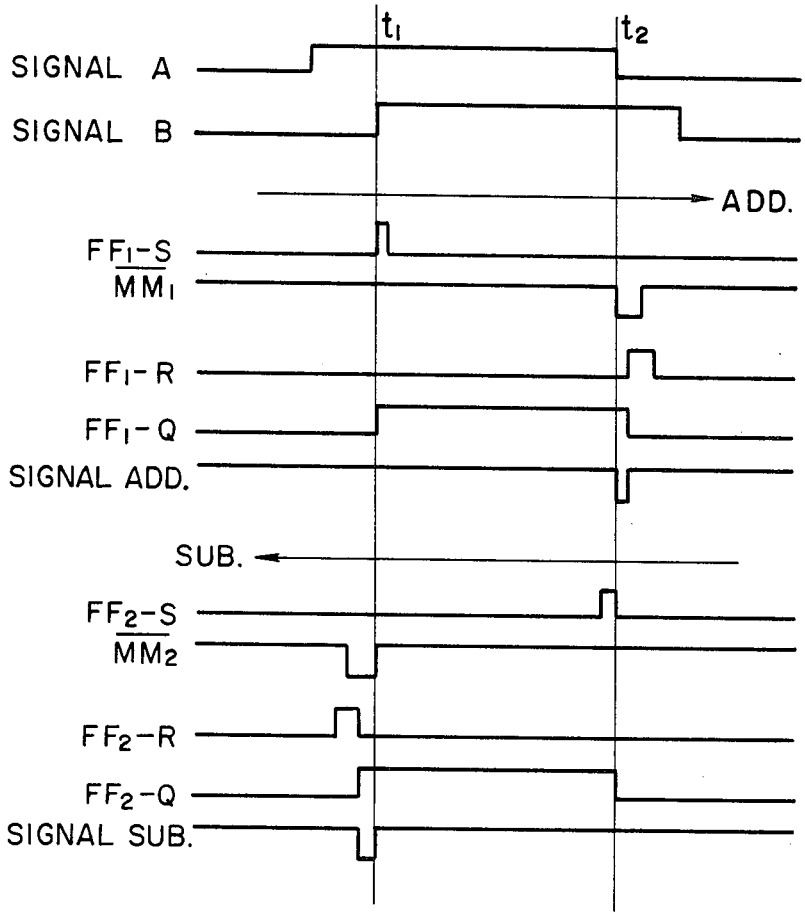
FIG. 7 is a time chart for explaining the operations of the generator circuit of FIG. 6.

A preferred embodiment of the addition and subtraction signal generator circuit will be explained with reference to the FIGS. 6 and 7. The pre- and post-sensors 14 and 15 receive light from the light source 16 before the coin reach the pre- and post-sensors 14 and 15. Then the sensors 14 and 15 are sequentially blocked from light by the coin while the coin passes on the sensors 14 and 15, and again receive light from the light source 16 after the coin has passed. The pre- and post-sensors 14 and 15 are electrically connected to junctions "Y" and "Z" of the generator circuit of FIG. 6, respectively. The pre-sensor 14 generates a signal (or pulse) A at the junction "Y" due to the blocking of light and the post-sensor 15 generates a signal (or pulse) B at the junction "Y" due to the blocking of light.

When the coin passes in the normal order or forwardly, the signal A first rises and then the signal B rises at a time $t_1$. In such a case, an L (low) level signal is issued from an inverter $INV_2$ and is delayed through a delay circuit $D_1$. During the delay, a pulse $FF_1$-S for setting a flip-flop $FF_1$ is put out from an AND gate $AND_1$ through an OR gate $OR_1$.

Then, when the signal A falls at a timing $t_2$, and is delayed through a delay circuit $D_3$. During this delay, a monostable multivibrator $\overline{MM}_1$ is triggered by an H (high) level signal from the inverter $INV_1$ to issue a waveform $\overline{MM}_1$ at an input of an inverter $INV_3$ or an OR gate $OR_3$.

The waveform $\overline{MM}_1$ adds a H level pulse to one of inputs of a NAND gate $NAND_3$ through the inverter $INV_3$. On the other hand, the waveform $\overline{MM}_1$ is inverted and passed through an OR gate $OR_3$. The waveform $\overline{MM}_1$ thus passed is then delayed by a delay circuit $D_5$. The delayed pulse (waveform $FF_1$-R) is put in at a reset terminal R of the flip-flop $FF_1$. Therefore, a waveform $FF_1$-Q is put out at an output terminal Q of the flip-flop $FF_1$. Consequently, a NAND gate $NAND_3$ issues an add pulse, that is, a signal ADD.

In case where the coin, which has once passed the pre- and post-sensors 14 and 15, passes the sensors in the abnormal order or reversely, the signal B first rises and the signal A rises to set a flip-flop $FF_2$. In a similar manner as described above, a subtraction pulse or a signal SUB is issued from a NAND gate $NAND_4$.

The operations of the coin counting system thus constructed according to the present invention will be described in the following.

The coin stopper 10 is released to start the counting operations by turning the circumference of the stopper shaft 11 from its position projecting into the coin path 5 so that its notch 12 is brought to align with the inside of the coin path 5. As a result, the coins 2 to be counted are consecutively supplied from the rotary disc 1 into the coin path 5 and are conveyed at a high speed by the action of the conveyor belt 6. In this meanwhile, the coins 2 shield the pre-sensor 14 and then the post-sensor 15 so that the pre-sensor signal A and the post-sensor signal B are fed to the generator circuit 20 from the respective sensors 14 and 15, as illustrated in FIG. 5. In response to the pre-sensor and post-sensor signals A and B corresponding to the counting operation of one coin, one addition signal ADD is generated and fed through an inverter 22 to one input terminal of an AND circuit 23.

In the meanwhile, the addition signal ADD is fed to a reset terminal of a NAND circuit 24 and maintains the flip-flop FF at its reset state, which in turn maintains the other input terminal of the AND circuit 23 high. Therefore, the addition signal can pass through the AND circuit 23 to feed one count signal C to the counter 21. Thus, the coins 2 are counted up in succession. Now, let the case be considered, in which the conveyor belt 6 for conveying the coins 2 is reversed by the reaction when it is stopped or in which the conveyor belt 6 is manually reversed when the coin path 5 is jammed up with the coins. In this case, if the coins having been counted are conveyed backward to pass in the abnormal order from the post-sensor 15 to the pre-sensor 14, the second shots of the post-sensor and pre-sensor signals B and A are consecutively generated in the phase relationship shown in FIG. 5. In this particular case, not the addition signal ADD but the subtraction signal SUB is generated to set the flip-flop FF so that the count signal C is not generated even in response to the addition signal ADD (corresponding to the third shots of the pre-sensor and post-sensor signals illustrated in FIG. 5), which is generated in the subsequent coin counting operation. As a result, the subtraction is substantially effected by the single coin, which has been conveyed backward in the coin path 5, so that all the coins are correctly counted. Thus, the coin counting system according to the present invention can be produced at a low cost with a reduced number of parts without any necessity of such a complex counting circuit as one which uses a reversible or an UP. Down Counter, for example.

As has been described hereinbefore, the coin counting system according to the present invention can enjoy an advantage in that it can accomplish an error-freed reliable counting operation smoothly and promptly, although it is simply constructed. The coin counting system can also enjoy another advantage in that the counting operation, in cases where the coins are conveyed backward, is processed with the use of the simple circuit construction so that the number of the coins can be correctly counted.

What is claimed is:

1. A coin counting system comprising: a coin path for guiding a series of coins to be counted therealong; conveying means juxtaposed to said coin path for conveying the coins in said coin path; light emitting means disposed at a downstream portion of said coin path for emitting a light; pre- and post-sensors juxtaposed to each other upstream and downstram in the coin conveying direction and arranged to receive the light emitted from said light emitting means and to be at least included temporality within the generally triangular space, which is defined by the inner wall of said coin path and by the facing circumferential portions of the two coins being conveyed adjacent to each other along said coin path, thereby generating respective signals; a generator circuit made receptive of the signals of said pre- and post-sensors for generating an addition signal, when said two coins pass in the normal order from said pre-sensor to said post-sensor, and a subtraction signal when said two coins pass in the abnormal order from said post-sensor to said pre-sensor; means made responsive to the addition and subtraction signals of said generator circuit for generating a count signal in response to the addition signal and for generating no count signal by the addition signal subsequent to the subtraction signal to the subtraction signal and a counter for counting up the number of said coins, when it receives said count signal, whereby the coin having been counted can be prevented from being erroneously counted up again even if it is conveyed backward.

2. A coin counting system according to claim 1, further comprising stopper means disposed in said coin path just downstream of said pre- and post-sensors for stopping the leading one of said coins.

3. A coin counting system according to claim 2, wherein said stopper means includes a stopper shaft having its axis intersecting the bottom of said coin path at a right angle and having its head formed with such a notch as to cut on the extension of the inner wall of said coin path, and a rotary solenoid mounted on said stopper shaft for turning the same thereby to effect the coin stopping operation.

4. A coin counting system according to claim 1, wherein said pre- and post-sensors are constructed of phototransistors.

5. A coin counting system according to claim 2, wherein said light emitting means is constructed of a diode for emitting an ultrared ray.

* * * * *